United States Patent [19]

Thorogood

[11] 4,222,756

[45] Sep. 16, 1980

[54] TONNAGE NITROGEN GENERATOR

[75] Inventor: Robert M. Thorogood, Macungie, Pa.

[73] Assignee: Air Products and Chemicals, Inc., Allentown, Pa.

[21] Appl. No.: 36,488

[22] Filed: May 7, 1979

[30] Foreign Application Priority Data

May 12, 1978 [GB] United Kingdom ..... 19125/78

[51] Int. Cl.[3] ..... F25J 3/04

[52] U.S. Cl. ..... 62/13; 62/29; 62/38

[58] Field of Search ..... 62/29, 30, 31, 13–15, 62/22, 38, 39

[56] References Cited

U.S. PATENT DOCUMENTS

| | | | |
|---|---|---|---|
| 2,497,589 | 2/1950 | Dennis | 62/29 |
| 2,587,820 | 3/1952 | Cartier | 62/29 |
| 3,062,016 | 11/1962 | Dennis et al. | 62/29 |
| 3,173,778 | 3/1965 | Gaumer, Jr. | 62/29 |
| 3,208,231 | 9/1965 | Becker | 62/30 |
| 3,593,534 | 7/1971 | Seidel | 62/13 |

*Primary Examiner*—Norman Yudkoff

*Attorney, Agent, or Firm*—Ronald B. Sherer; E. Eugene Innis

[57] ABSTRACT

A process for producing nitrogen which comprises removing all or substantially all carbon dioxide and water vapor from air, introducing said air at between 85 and 125 psia and below −260° F. into a first distillation column, expanding at least part of the overhead product from said first distillation column in an expander to a pressure in the range 45 to 70 psia, expanding at least part of the bottoms product from said first distillation column to a pressure in the range 45 to 70 psia, introducing at least a part of both expanded products into a second distillation column, using at least part of the refrigeration contained in the bottoms product of said second distillation column to provide reflux in said first distillation column, expanding at least a part of the bottoms product from said second distillation column to a pressure equal to or less than 30 psia and using at least part of the refrigeration therein to provide reflux in said second distillation column, and collecting nitrogen product from the top of said second distillation column. The present invention also relates to an apparatus for carrying out the process.

5 Claims, 4 Drawing Figures

TONNAGE NITROGEN GENERATOR

This invention relates to a process for producing gaseous nitrogen and to an apparatus in which said process can be carried out.

Figure 1:
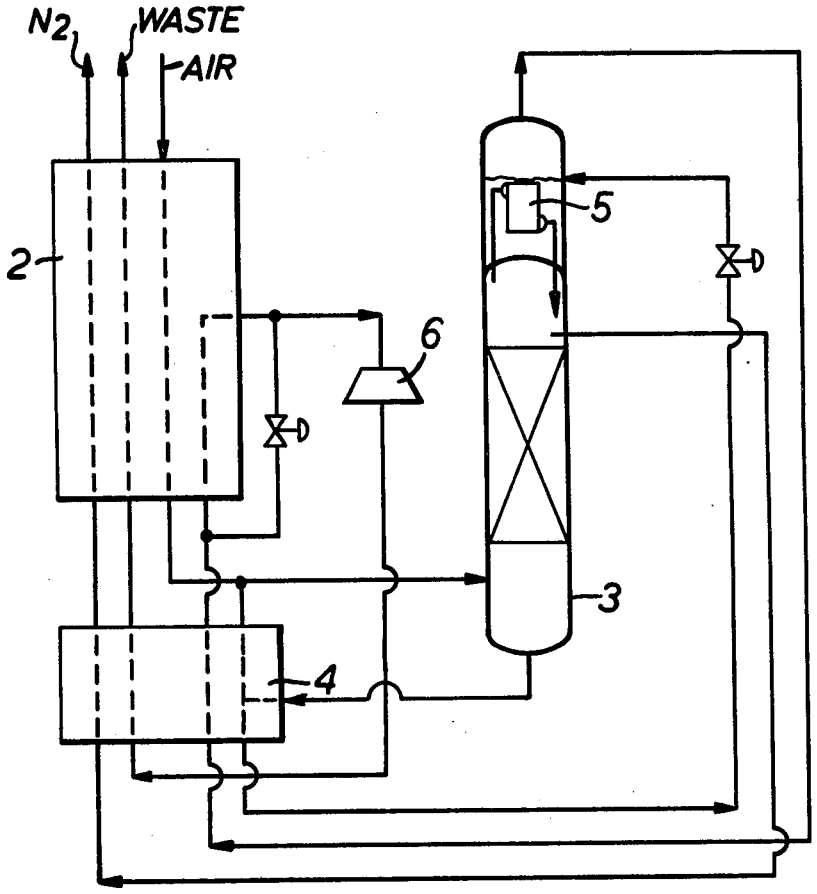
Figure 2:
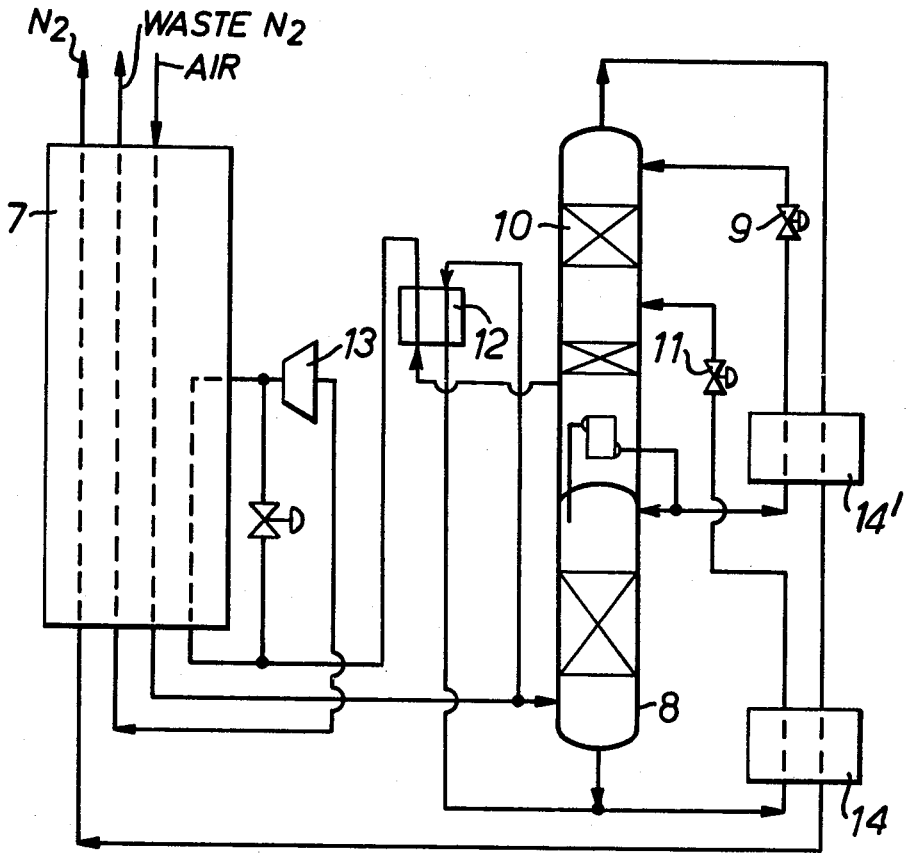
Figure 3:
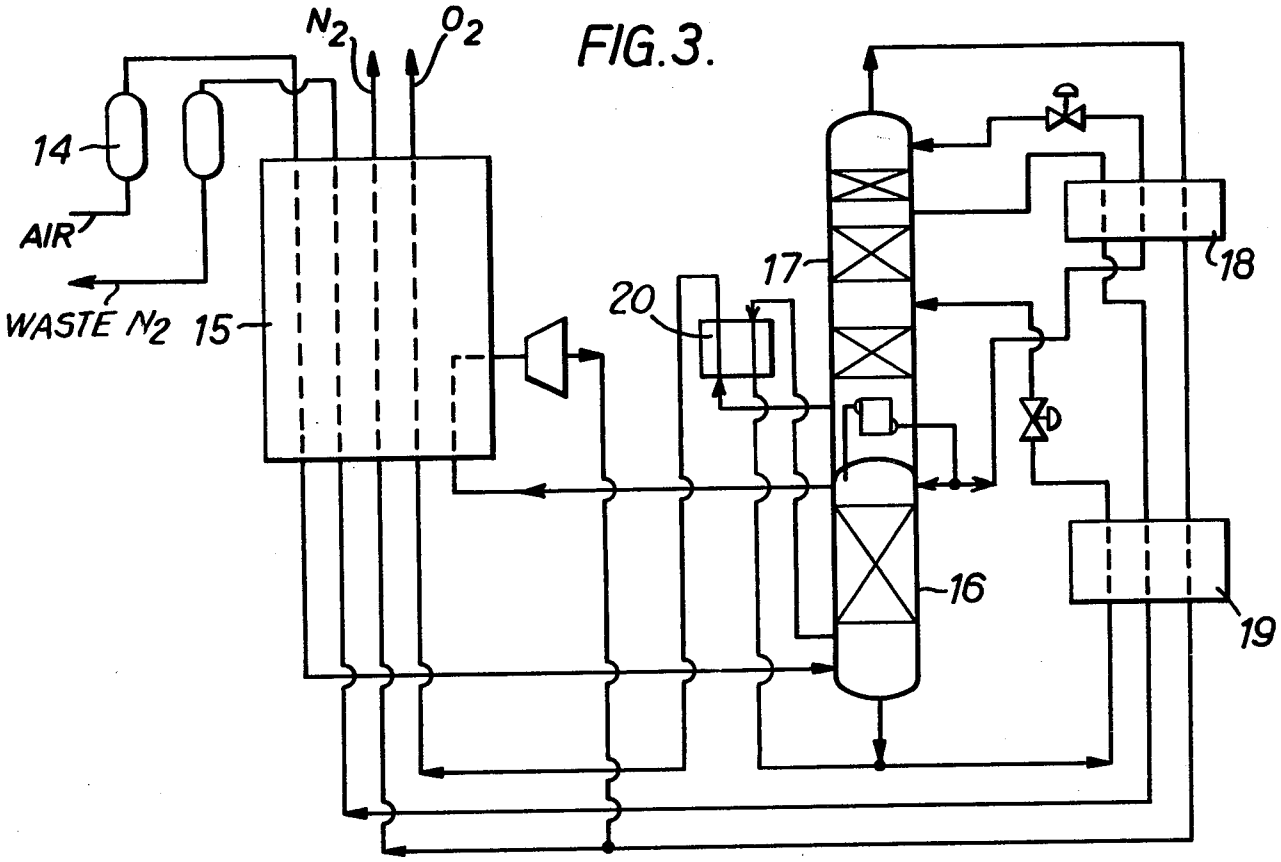

FIGS. 1 to 3 of the accompanying drawings are simplified flow sheets of known installations for producing gaseous nitrogen.

Referring to FIG. 1, air at 100 psia and 95° F. is cooled to near its saturation temperature in reversible heat exchanger 2 and the major portion is introduced into a distillation column 3 containing approximately forty trays. The gaseous overhead product, comprising substantially pure nitrogen leaves the column 3 at about 95 psia and is warmed in heat exchanger 4 and reversible heat exchanger 2. The bottoms product, comprising 35% oxygen is sub-cooled in heat exchanger 4 and is joined by liquid formed from the remainder of the air leaving reversible heat exchanger 2. The sub-cooled liquid is expanded to 50 psia and used to cool reflux condenser 5 servicing distillation column 3 before passing through, in sequence, heat exchanger 4, part of reversible heat exchanger 2, expander 6, heat exchanger 4 and reversible heat exchanger 2.

For each mole of air entering the installation at 100 psia approximately 0.4 moles of nitrogen product are obtained at 90 psia. The total power consumption of this process is approximately 0.26 kWh/Nm$^3$ nitrogen product.

FIG. 2 shows the first major improvement over the installation shown in FIG. 1. In this installation air at 150 psia is cooled to near its saturation temperature in reversible heat exchanger 7 and is introduced into the high pressure column 8 of a double distillation column. The overhead product, comprising substantially pure liquid nitrogen is sub-cooled in heat exchanger 14' and is expanded to 55 psia at valve 9 and introduced into the top of the low pressure column 10. The bottoms product from the high pressure distillation column, comprising 38% oxygen is sub-cooled in heat exchanger 14, expanded to 55 psia at valve 11 and is introduced into the middle zone of the low pressure column 10. Substantially pure nitrogen leaves the top of the low pressure column 10 and is warmed in heat exchangers 14' and 14 and reversible heat exchanger 7. A stream containing approximately 60% oxygen is taken from low pressure column 10, is warmed in heat exchanger 12, and subsequently passes through part of reversible heat exchanger 7, expander 13, and reversible heat exchanger 7 before venting to atmosphere.

For each mole of air entering the installation at 150 psia approximately 0.65 moles of gaseous nitrogen are produced at 50 psia. The total power consumption of this process adjusted to give a product at 90 psia, is approximately 0.23 kWh/Nm$^3$ nitrogen produced.

It should be noted that the expander 13 will require special precautions to be taken in view of the relatively high percentage of oxygen passing through the expander.

Referring to FIG. 3, air at 100 psia is passed through one of a pair of molecular sieves 14 to remove any carbon dioxide or water vapour present. (These impurities are normally removed in reversible heat exchangers). The air is then cooled to near its saturation temperature in heat exchanger 15 and is introduced into the high pressure column 16 of a double distillation column. Part of the overhead and all the bottoms products from the high pressure column 16 are sub-cooled in heat exchangers 18 and 19 respectively, expanded to 20 psia, and introduced into low pressure column 17 where shown. Substantially pure nitrogen passes from the top of the low pressure column 17 and through heat exchangers 18, 19 and 15. A waste $N_2$ stream from the low pressure column 17 is passed through heat exchangers 18, 19 and 15 and is used to regenerate the molecular sieves 14.

For each mole of air entering the installation at 100 psia approximately 0.72 moles of nitrogen product are obtained at 15 psia. The total power consumption of this process, corrected to give a product at 90 psia, is approximately 0.25 kWh/Nm$^3$ nitrogen product.

U.K. Pat. No. 1,125,377 discloses a process in which air is compressed and precooled. Water, carbon dioxide and acetylene are then removed in adsorbers and the remaining air is expanded to between 10 and 15 atmospheres before being introduced into the high pressure column of a double distillation column. The bottoms product from the high pressure column is expanded and introduced into the middle of the low pressure column at between 2 and 8 atmosphere whilst the overhead product, in liquid form, is expanded and introduced into the upper column as reflux. Pure liguid oxygen from the bottom of the upper column is expanded and passed through a reflux condenser in the low pressure columns. The overhead product in the low pressure column is pure nitrogen. An analysis based upon the information given in the patent specification shows that for oxygen evaporating in condenser 10 at 19 psia, the upper column pressure is 80 psia and the lower column pressure is 250 psia. Thus the compressed air entering the installation is at a pressure of approximately 350 psia. This would preclude the use of currently available reversible heat exchangers which will not operate reliably above 200 psia. The approximate power consumption to produce nitrogen product at 90 psia would be about 0.26 kWh/Nm$^3$ nitrogen product.

An object of the present invention is to provide an installation for producing gaseous nitrogen which, at least in its preferred form, and when compared at a product pressure of 90 psia, will have a power consumption which is lower than those referred to with regard to FIGS. 1, 2 and 3.

According to the present invention there is provided a process for producing nitrogen which comprises removing all or substantially all carbon dioxide and water vapour from air, introducing said air at between 85 and 125 psia and below—260° F. into a first distillation column, expanding at least part of the overhead vapor from said first distillation column in an expander to a pressure in the range 45 to 70 psia, expanding at least part of the bottoms product from said first distillation column to a pressure in the range 45 to 70 psia, introducing at least a part of both expanded products into a second distillation column, using at least part of the refrigeration contained in the bottoms product of said second distillation column to provide reflux in said first distillation column, expanding at least a part of the bottoms product from said second distillation column to a pressure equal to or less than 30 psia and using at least part of the refrigeration therein to provide reflux in said second distillation column, and collecting nitrogen product from the top of said second distillation column.

Although carbon dioxide and water vapour could be removed from the air by molecular sieves they are preferably removed in one or more reversible heat exchangers disposed upstream of the first distillation column. If a reversible heat exchanger is employed the air leaving the reversible heat exchanger should preferably be slightly above saturation as the presence of liquid in reversible heat exchangers prevents the proper control of their operation. If desired the air could enter the first distillation column in the liquid or part liquid phase although the gas phase is preferred.

If a reversible heat exchanger is used, at least part of the overhead product from the first distillation column is preferably warmed in the reversible heat exchanger, expanded in an expander and returned to the second distillation column. In order to inhibit liquid forming in the cold end of the reversible heat exchanger in such an arrangement, the overhead product from the first distillation column is preferably warmed, for example in heat exchange with a gaseous fraction taken from the first distillation column and returned to the bottoms product of the first distillation column in liquid or partially liquid phase.

Preferably, the bottoms product from the first distillation column is sub-cooled before being expanded. Similarly, the bottoms product from the second distillation column is preferably sub-cooled before being expanded.

Advantageously, the bottoms product from the second distillation column contains (by moles) between 40% and 75% oxygen.

The present invention also provides an apparatus for producing gaseous nitrogen, which apparatus comprises a compressor capable of providing air at between 85 and 125 psia, means for removing carbon dioxide and water vapour from air, a first distillation column arranged to receive air from said compressor, a second distillation column, an expander in which at least a part of the overhead product from said first distillation column can be expanded to between 45 and 70 psia, means for expanding at least a part of the bottoms product from said first distillation column to between 45 and 70 psia, means for introducing at least part of each expander product into said second distillation column, a reflux condenser associated with said first distillation column and arranged to receive, in use, refrigeration from the bottoms product in said second distillation column, means for expanding at least part of the bottoms product from said second distillation column to a pressure equal to or less than 22 psia and means for using the refrigeration therein to provide reflux in said second distillation column and means for collecting nitrogen product from the top of said second distillation column.

For the avoidance of doubt the power consumptions quoted are those which we would actually expect to obtain from a working plant after allowing for the inefficiency of gas compression. They are all considerably greater than those theoretically attainable.

The reduction of power consumption in the present invention is a result of a closer approach to thermodynamic reversibility in the second distillation column than attained by the prior art.

Figure 4:
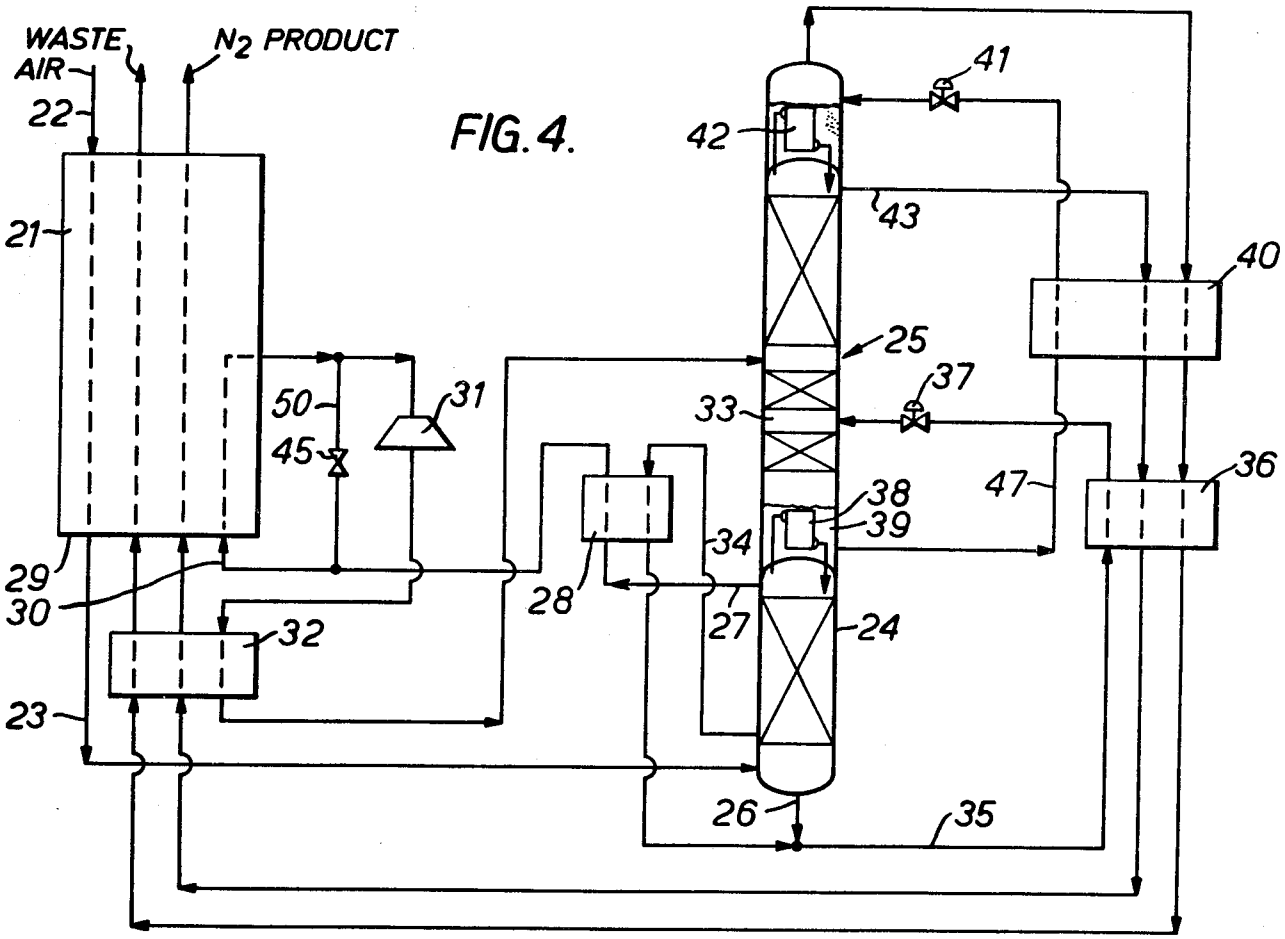

For a better understanding of the invention reference will now be made, by way of example, to FIG. 4 which is a simplified flow sheet of an installation in accordance with the invention.

Referring to the flow sheet, dust free air at 95° F. and 100 psia enters reversible heat exchanger 21 through conduit 22. Substantially all the water vapour and carbon dioxide in the air condenses in the reversible heat exchanger 21 and the remaining vapour leaves the reversible heat exchanger 21 at −272° F. through conduit 23. The vapour enters the first section 24 of distillation column 25 where it is separated into a liquid bottoms product 26 at −275° F. containing (by moles) 40% oxygen and a gaseous overhead fraction 27 containing (by moles) about 98% nitrogen at −282° F. The overhead fraction 2.7 is warmed to −278° F. in heat exchanger 28 against condensing air and the majority of the emerging gas is introduced into the cold end 29 of reversible heat exchanger 21 through conduit 30.

The nitrogen is withdrawn from reversible heat exchanger 21 at −156° F. and after joining the gas passing through by pass 33 is expanded through expander 31 to 54 psia and −272° F. Expanded gas is cooled to −276° F. in heat exchanger 32 and is introduced into the second section 33 of distillation column 25.

The bottoms fraction 26 from the first section 24 of distillation column 25 is supplemented by a small quantity of liquid formed by withdrawing vapour through conduit 34, liquifying it in heat exchanger 28 and returning the liquid to conduit 35. The liquid in conduit 35 is sub-cooled to −290° F. in heat exchanger 36 and is let down to 53 psia and −291° F. at Joule-Thompson valve 37 before being introduced into the second section 33 of the distillation column 25.

The enriched $O_2$ liquid at the bottom of the second section 33 is reboiled against condensing $N_2$ in the reflux condenser 38 associated with the first section 24 of the distillation column 25.

The bottoms fraction 39 contains approximately 50% oxygen and leaves the second section 33 through conduit 47. It is then subcooled to −296° F. in heat exchanger 40 and is expanded through Joule-Thompson valve 41 to 20 psia and −307° F. The refrigeration in the resulting two phase mixture is used to condense $N_2$ vapour in the reflux condenser 42 associated with the second section 33 of the distillation column 25. The vapour obtained from the two phase mixture is passed through heat exchangers 40, 36 and 32 and through reversible heat exchanger 21 which it leaves at 88° F.

The overhead product 43 from the second section 33 of the distillation column 25 is substantially pure nitrogen and is passed through heat exchangers 40, 36 and 32 and reversible heat exchanger 21 before emerging at 88° F. and 47.5 psia. A flow of 0.58 moles of product $N_2$ is obtainable from 1 mole of air feed.

The temperature at the cold end 29 of the reversible heat exchanger 21 is conveniently controlled by remotely operable valve 45 mounted in bypass line 50.

The power consumption of this process, adjusted to give a product at 90 psia, is approximately 0.21 $kWh/Nm^3$ which represents a substantial power saving over the processes described with reference to FIGS. 1, 2 and 3.

It should be noted that the expander will be smaller than those used in the installation shown in FIGS. 2 and 3 and will not require the safety precautions necessary for an expander handling enriched oxygen concentrations.

It should be understood that the reversible heat exchanger works in conventional manner although details of the change-over valves have been omitted for clarity.

The process is especially suited to large flows of $N_2$, e.g. above 100 tons/day where power economy is of importance.

What is claimed is:

1. A process for producing substantially pure gaseous nitrogen product which comprises:

(a) removing substantially all of the carbon dioxide and water vapor from a feed air stream;

(b) introducing said dry, carbon dioxide-free feed air stream into a first distillation column and forming an overhead vapor fraction and a bottom liquid fraction;

(c) expanding at least part of said overhead vapor fraction in a work expansion engine to a second, lower pressure;

(d) expanding at least part of said bottoms liquid fraction to a second, lower pressure;

(e) introducing at least part of both expanded lower pressure fractions into a second distillation column;

(f) providing a condenser-reboiler at least partially submerged in the liquid bottom product of said second distillation column and providing reflux to said first distillation column from said condenser-reboiler;

(g) expanding at least a portion of the liquid bottom product of said second distillation column to a further lower pressure;

(h) utilizing said expanded, further lower pressure liquid bottom product from said second distillation column to provide refrigeration for supplying reflux to said second distillation column; and (i) collecting substantially pure gaseous nitrogen product from the top of said second distillation column.

2. A process according to claim 1, wherein at least part of the overhead fraction from the first distillation column is warmed with a gaseous fraction taken from the first distillation column and returned to the bottoms fraction of the first distillation column in liquid or partially liquid phase.

3. A process according to claim 1, wherein the bottoms fraction from the first distillation column is sub-cooled before being expanded.

4. A process according to claim 1, wherein the bottoms product from the second distillation column is sub-cooled before being expanded.

5. An air separation column comprising: a high pressure section, air feed inlet means connected to said high pressure section for supplying air thereto, an integral low pressure section mounted above said high pressure section, a condenser reboiler in the bottom of said low pressure section connected to receive vapor from said high pressure section and return liquid reflux to the top of said high pressure section, a third column section including a second condenser-reboiler operatively connected to receive vapor from the top of said low pressure section and return liquid reflux to the top of said low pressure section, conduit means connecting the bottom of said low pressure section to said third column section for passing bottoms liquid fraction from said low pressure section to said third column section to provide refrigeration for said second condenser-reboiler, conduit means for passing both overhead vapor and bottoms liquid fraction from said high pressure section to said low pressure section, expansion means in said conduit means for expanding both said overhead vapor and bottoms liquid fraction before injection into said low pressure section, and conduit means extending from the top of said third column section for withdrawing substantially pure product nitrogen.

* * * * *